United States Patent [19]

Fukunaga

[11] 4,363,207

[45] Dec. 14, 1982

[54] TENSION REGULATOR IN DOUBLE TWISTER

[75] Inventor: Mitsuo Fukunaga, Kyoto, Japan

[73] Assignee: Murata Kikai Kabushiki Kaisha, Japan

[21] Appl. No.: 193,031

[22] Filed: Oct. 2, 1980

[30] Foreign Application Priority Data

Oct. 3, 1979 [JP] Japan ..... 137787/79

[51] Int. Cl.[3] ..... D01H 7/86; D01H 13/10

[52] U.S. Cl. ..... 57/58.86; 242/150 R

[58] Field of Search ..... 57/58.49, 58.83–58.86, 57/352; 242/147 R, 150 R, 153, 156, 152.1

[56] References Cited

U.S. PATENT DOCUMENTS 2,827,756 3/1958 Kellogg et al. ..... 57/58.86

2,955,775 10/1960 Johnson ..... 242/150

*Primary Examiner*—John Petrakes

*Attorney, Agent, or Firm*—Barnes, Kisselle, Raisch, Choate, Whittemore & Hulbert

[57] ABSTRACT

A tension regulator in a double twister comprising a tenser body including a plurality of stages and ring tensers freely fitted in the respective stages of the tenser body. The tension regulator is mounted on the top end of a cop placed at the center of a stationary disk.

4 Claims, 2 Drawing Figures

TENSION REGULATOR IN DOUBLE TWISTER

BACKGROUND OF THE INVENTION

In a double twister, the function of imparting a tension to yarn is one important function having an influence on formation of balloons and occurrence of yarn breakage and fluffs. The quantity of tension to be applied should be appropriately set according to the yarn speed, spindle rotation number and the properties and fineness of yarn. Moreover, strictly speaking, a delicate attention should be paid so that the quantity of tension to be applied is adjusted according to the quantity of yarn unwound from the cop.

As the tenser, there have ordinarily been used a ball tenser comprising a ball and a ball seat, a washer tenser comprising a washer and a washer receiver, and a tension device constructed by combining both these tensers. However, these conventional tensers are defective and insufficient in various points. For example, delicate adjustment is impossible, or if possible, the cop should be taken out every time adjustment is made. Moreover, the mechanism of prior tensers is complicated and troubles and disorders are readily caused. Furthermore, the life of the tensioning mechanism is much limited.

SUMMARY OF THE INVENTION

The present invention relates to a tension regulator in a double twister.

An object of the present invention is to provide a tension regulator by which the tension to be applied to a yarn unwound from a cop may be adjusted easily and precisely without removing a cop from a spindle every time an adjustment of yarn tension is made.

DETAILED DESCRIPTION OF THE INVENTION

The present device will now be described in detail with reference to the accompanying drawings.

Figure 1:
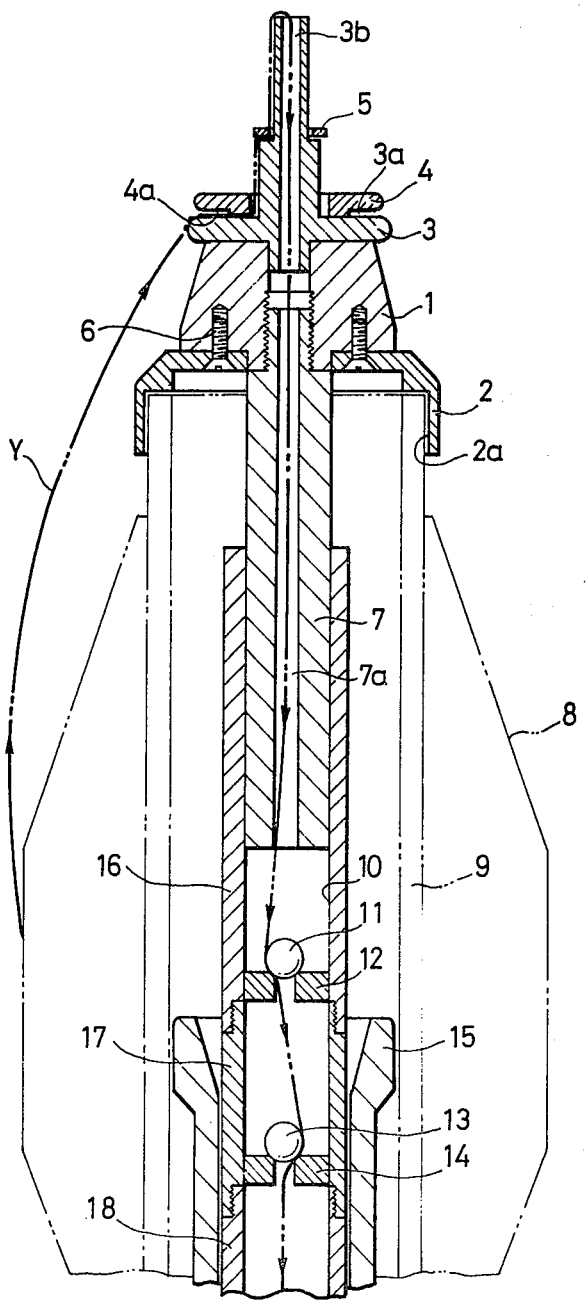
FIG. 1 is a longitudinally section view illustrating one embodiment of the present device.

FIG. 1 illustrates a composite tenser device comprising a tenser regulator according to the present invention and a ball tenser. Referring to FIG. 1, a covering 2 having a guide portion 2*a* for a bobbin 9 is integrated with and fixed to a base stand 1 by means of a screw 6, and a guide tube 7 having a yarn passage 7*a* formed at the center of the lower end portion thereof is screwed to the base stand 1. A tenser body 3 having a yarn guide hole 3*b* at the center thereof and being composed of an abrasion-resistant material is integrally fixed to the top end face of the base stand 1, and the tenser body 3 is formed to have a multi-staged cylindrical shape (two stages in the embodiment shown in the drawings) defined by a flange end face 3*a* so that the diameter of the cylinder is decreased toward the top end of the yarn passage 7*a*. Ring tensers 4 and 5 corresponding to the sizes of the cylinder at the respective stages are freely fitted in these stages with clearances allowing passage of a yarn Y. The ring tensers 4 and 5 have different hollow annular shapes corresponding to the sizes of the cylindrical shapes of the respective stages of the tenser body 3. As the size of the ring tenser 4 is increased, an escape 4*a* is formed on the lower end face of the ring tenser 4 so that the contact area between said lower end face 4*a* and the top end face 3*a* of the flange is controlled to a level below a certain limit and no bad influences are imposed on the yarn Y when a tension is given thereto.

A cop 8 is placed on a stationary disk 15, and guide pipes 16, 17 and 18 having a multi-staged ball therein tenser comprising balls 11 and 13 and ball seats 12 and 14 are screwed to the central portion of the stationary disk 15. The guide tube 7 is dismountably fitted on the inner face of the guide pipes, so that when the yarn Y travels between the balls 11 and 13 and the ball seats 12 and 14 via the yarn passage 7*a*, a tension is given to the yarn Y by the ball tenser in addition to the tension given by the above-mentioned tenser according to the present invention.

In the above-mentioned embodiment, the tenser according to the present invention is combined with the ball tenser. However, adoption of such composite tensioning system is not indispensable, but the intended effect can be attained sufficiently only by the tenser of the present invention.

Figure 2:
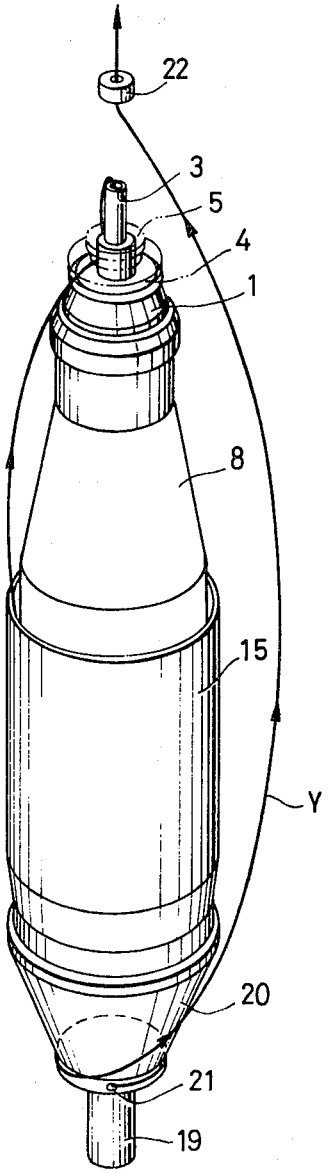
FIG. 2 is a perspective view illustrating the attachment of the present device.

FIG. 2 is a perspective view showing the state where the tenser of the present invention is attached to a double twister. Referring to FIG. 2, the yarn Y tensioned by the tension regulator of the present invention and the ball tenser passes through a yarn hole 21 formed through a rotary disk 20 and the yarn Y passes through a snail guide 22 while forming a balloon. Then, the yarn is wound on a package (not shown). Incidentally, reference numeral 19 represents a spindle fixed integrally to the rotary disk 20.

The operation of the apparatus according to the present device will now be described.

The yarn Y unwound from the cop 8 passes through the contact face clearance between the top end face 3*a* of the flange and the lower end face of the ring tenser 4, and the yarn Y is tensioned while the yarn Y passes through the clearance between the tenser body 3 and the ring tenser 4. Then, the yarn Y passes through the tenser body 3 and the ring tenser 5. Thus, the yarn Y is tensioned stepwise, and the tensioned yarn Y is guided into the yarn guide hole 3*b* formed on the tenser body 3. During this passage, the tension corresponding to the sum of the tensions given at the respective stages is imparted to the yarn. Various ring tensers are used and they are appropriately added or removed according to the desired quantity of tension. Namely, necessary ring tensers are selected and attached so as to impart a predetermined quantity of tension to the yarn Y.

The yarn Y guided in the yarn guide hole 3*b* passes through the yarn passage 7*a* of the guide lever 7, and while the yarn Y then passes through the multi-staged tenser constructed by the ball 11 and ball seat 12 and the ball 13 and ball seat 14 within the guide pipes 16, 17 and 18, the yarn Y is further tensioned. Accordingly, the sum of the quantity of the tension given by the apparatus of the present device and the quantity of the tension thus additionally given by this multi-staged ball tenser is imparted to the yarn Y.

The tensioned yarn Y passes through a yarn passage (not shown) in the stationary disk 15 and then through the yarn hole 21 formed through the rotary disk 20, and by rotation of the spindle 19 integrated with the rotary disk 20, which is driven by a power source (not shown), the yarn Y is twisted while forming a balloon between the rotary disk 20 and the snail guide 22, and after passage through the snail guide 22, the yarn Y is wound on a package (not shown).

In the above-mentioned structure of the tenser system of the present invention, a necessary quantity of tension can be imparted to a yarn by the tension-adjusting apparatus comprising the tenser body 3 having a multi-staged cylindrical shape and various ring tensers 4 and 5 corresponding to the respective stages of the tenser body 3. For example, if a large quantity of tension is desired, both the ring tensers 4 and 5 are simultaneously used, and if only a small quantity of tension is desired, the ring tenser 5 having a smaller diameter alone is used.

When the above tenser system according to the present invention is combined with the ball tenser, an approximate tension is given to the yarn by the ball tenser and insufficient quantity of tension can be additionally imparted to the yarn by the tension regulator of the present invention. In this case, therefore, delicate adjustment of tension can be accomplished advantageously.

In each case, adjustment of tension can be performed assureadly by simple means while the cop 8 is kept attached.

What is claimed is:

1. A double twister including a tension regulator and a spindle, a stationary disk disposed above the spindle adapted to receive a cop placed at the center of the stationary disk, a guide tube with a yarn passage at the center thereof extending axially of and within the stationary disk, said tension regulator comprising a tenser body having a multi-staged cylindrical shape and a yarn guide hole communicating with the yarn passage of the guide tube adapted to be mounted on the top end of a cop placed at the center of a stationary disk disposed above the spindle, and ring tensers freely fitted on the respective stages of the tenser body with clearances allowing passage of yarn between the ring tensers and the tenser body.

2. Structure as claimed in claim 1, wherein an escape is formed on the lower end face of the ring tenser so that the contact area between the lower face of the ring tenser and the top end face of a stage of the tenser body is controlled.

3. Structure as claimed in claim 2, wherein as least one ball tenser comprising a ball and ball seat is further provided at the central portion of the stationary disk.

4. Structure as claimed in claim 1, wherein at least one ball tenser comprising a ball and ball seat is further provided at the central portion of the stationary disk.

* * * * *